US008742380B2

(12) United States Patent
Hori et al.

(10) Patent No.: US 8,742,380 B2
(45) Date of Patent: Jun. 3, 2014

(54) TARGET SUPPLY DEVICE, EXTREME ULTRAVIOLET LIGHT GENERATION APPARATUS, AND METHOD FOR SUPPLYING TARGET

(71) Applicant: Gigaphoton Inc., Oyama (JP)

(72) Inventors: Tsukasa Hori, Hiratsuka (JP); Hideo Hoshino, Hiratsuka (JP); Tatsuya Yanagida, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 13/679,930

(22) Filed: Nov. 16, 2012

(65) Prior Publication Data

US 2013/0221246 A1 Aug. 29, 2013

(30) Foreign Application Priority Data

Feb. 27, 2012 (JP) ..... 2012-040182

(51) Int. Cl.
*G21K 5/02* (2006.01)
*G21K 5/04* (2006.01)

(52) U.S. Cl.
USPC ..... 250/504 R; 250/365

(58) Field of Classification Search
USPC ..... 250/365, 504 R; 89/8
See application file for complete search history.

(56) References Cited

U.S. PATENT DOCUMENTS

| | | | | |
|---|---|---|---|---|
| 4,572,964 | A * | 2/1986 | Honig | 307/106 |
| 4,625,618 | A * | 12/1986 | Howanick | 89/8 |
| 5,237,904 | A * | 8/1993 | Kuhlmann-Wilsdorf | 89/8 |
| 2010/0078577 | A1 * | 4/2010 | Moriya et al. | 250/504 R |
| 2010/0117009 | A1 * | 5/2010 | Moriya et al. | 250/504 R |

FOREIGN PATENT DOCUMENTS

JP 5-093791 A 4/1993

* cited by examiner

*Primary Examiner* — Jack Berman
*Assistant Examiner* — Kevin Chung
(74) *Attorney, Agent, or Firm* — McDermott Will & Emery LLP

(57) ABSTRACT

A target supply device is provided that may include a pair of rails arranged to face each other, the rails having electrically conductive properties, a target transport mechanism configured to supply a target material into a space between the rails and in contact with the rails, and a power supply connected to the rails and configured to supply a current to the target material through the rails. Methods and systems using the target supply device are also provided.

12 Claims, 9 Drawing Sheets

TARGET SUPPLY DEVICE, EXTREME ULTRAVIOLET LIGHT GENERATION APPARATUS, AND METHOD FOR SUPPLYING TARGET

CROSS-REFERENCE TO RELATED APPLICATION

The present application claims priority from Japanese Patent Application No. 2012-040182 filed Feb. 27, 2012.

BACKGROUND

1. Technical Field

The present disclosure relates to a target supply device, an apparatus for generating extreme ultraviolet (EUV) light, and a method for supplying a target.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to one aspect of the present disclosure may include a pair of rails arranged to face each other, the rails having electrically conductive properties, a target transport mechanism configured to supply a target material into a space between the rails to be in contact with the rails, and a power supply connected to the rails and configured to supply a current to the target material through the rails.

An apparatus for generating extreme ultraviolet light according to another aspect of the present disclosure may include a target supply device that includes a pair of rails arranged to face each other, the rails having electrically conductive properties, a target transport mechanism configured to supply a target material into a space between the rails to be in contact with the rails, and a power supply connected to the rails and configured to supply a current to the target material through the rails, a chamber provided with an inlet through which an externally supplied laser beam is introduced into the chamber, a laser beam focusing optical system for focusing the externally supplied laser beam in the chamber, a sensor for detecting a target outputted from the target supply device in the chamber, and a controller for controlling the target supply device based on a detection result of the sensor.

A method according to yet another aspect of the present disclosure for supplying a target in a target supply device that includes a pair of rails arranged to face each other, the rails having electrically conductive properties, a target transport mechanism, and a power supply connected to the rails may include transporting a solid target material by the target transport mechanism so that the target material comes into contact with the rails between the rails, and supplying a DC current to the target material in contact with the rails through the rails to melt the target material.

BRIEF DESCRIPTION OF THE DRAWINGS

Hereinafter, selected implementations of the present disclosure will be described with reference to the accompanying drawings.

DETAILED DESCRIPTION

Figure 1:
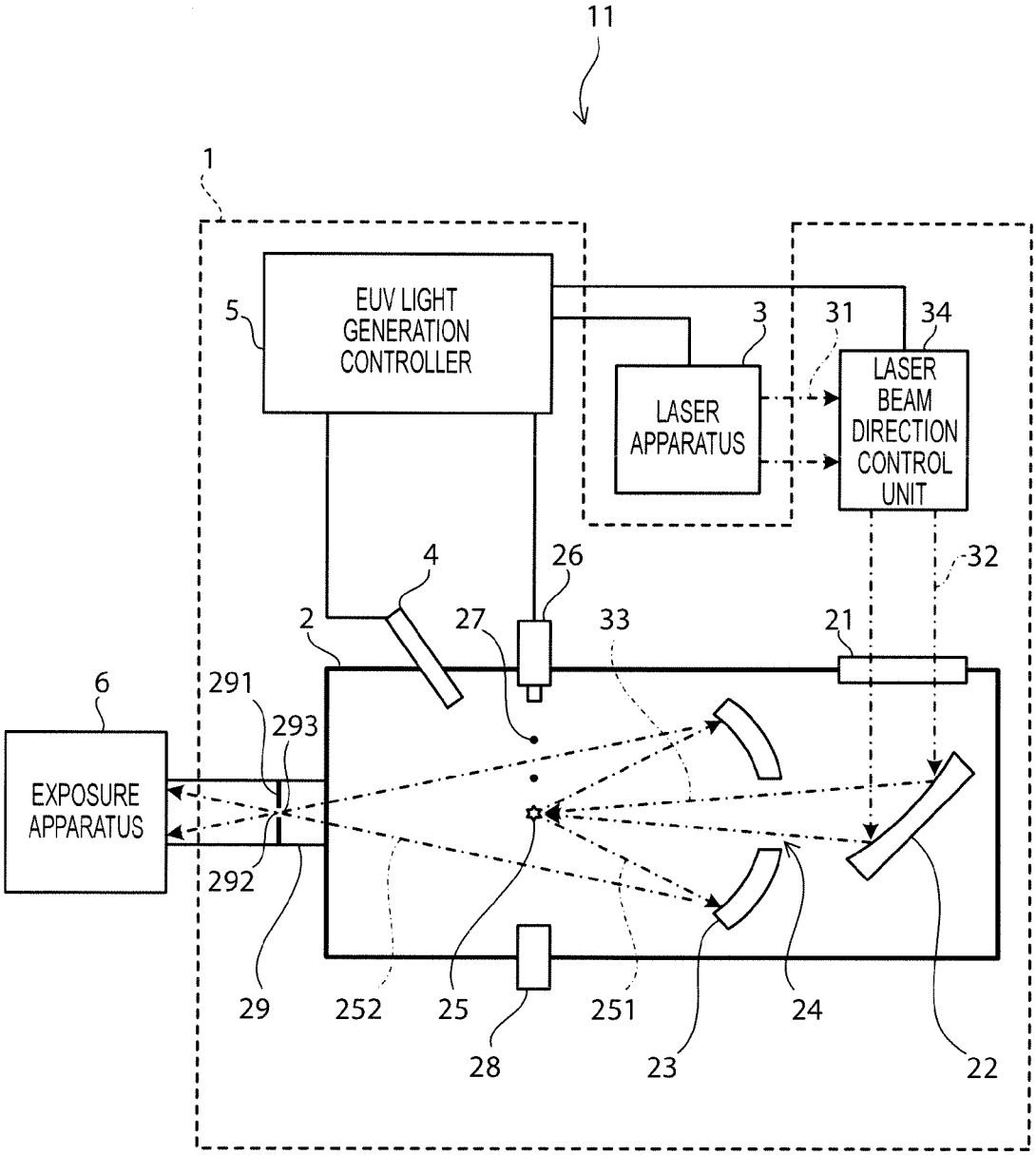
FIG. 1 schematically illustrates a configuration of an exemplary LPP type EUV light generation system.

Hereinafter, selected examples of the present disclosure will be described in detail with reference to the accompanying drawings. The examples to be described below are merely illustrative in nature and do not limit the scope of the present disclosure. Further, the configuration(s) and operation(s) described in each example are not all essential in implementing the present disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. Overview of Target Supply Device: First Example
3.1 Configuration
3.2 Operation
4. Details of Target Supply Device
4.1 Configuration
4.2 Operation
5. Second Example
6. Third Example
7. Fourth Example
8. Fifth Example
9. Sixth Example
10. Seventh Example
10.1 Configuration
10.2 Operation

1. OVERVIEW

In an LPP type EUV light generation apparatus, a target supply device may supply a target to a plasma generation region inside a chamber, and this target may be irradiated with a pulse laser beam in the plasma generation region. Then, the target may be turned into plasma, and EUV light may be emitted from the plasma.

In a future-generation LPP type EUV light generation apparatus, EUV light at a wavelength of approximately 6 nm may be demanded. As a material to generate EUV light at a wavelength of 6 nm, a refractory material such as terbium and gadolinium may be used. In order to melt such a refractory material to produce targets in the form of droplets, a structural material that withstands a temperature higher than the melting point of a refractory material may be required.

In examples of the present disclosure, a target material may be held between a pair of rails having electrically conductive properties, and a large current may be supplied to the target material through the pair of rails. With this configuration, the target material may be heated with Joule heat to thereby be molten. The molten target material may then be separated and accelerated along the pair of rails, and thus a target may be supplied to a plasma generation region in the form of a droplet.

2. OVERVIEW OF EUV LIGHT GENERATION SYSTEM

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 26. The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 31 travels, and the position at which the pulse laser beam 33 is focused. It will be appreciated that the various controls mentioned above are merely examples, and other controls may be added as necessary.

3. OVERVIEW OF TARGET SUPPLY DEVICE: FIRST EXAMPLE

3.1 Configuration

Figure 2:
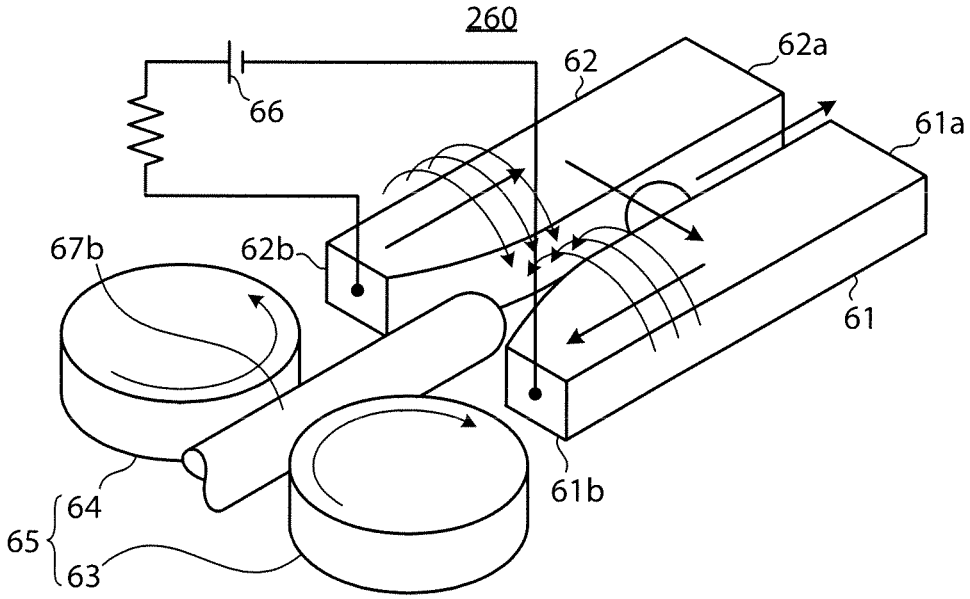
FIG. 2 is a perspective view schematically illustrating an exemplary configuration of a target supply device of a first example.

FIG. 2 is a perspective view schematically illustrating an exemplary configuration of a target supply device of a first example. As shown in FIG. 2, a target supply device 260 may include a pair of rails 61 and 62, a target transport mechanism 65, and a power supply 66.

The pair of rails 61 and 62 may be highly electrically conductive. One of the surfaces of each of the rails 61 and 62 may be curved as shown in FIG. 2, and the rails 61 and 62 may be arranged symmetrically with the curved surfaces of the respective rails 61 and 62 facing each other. The surfaces opposite to the curved surfaces of the rails 61 and 62 may be arranged to be parallel to each other. The pair of rails 61 and 62 configured as such may be positioned so that first ends 61*a* and 62*a* of the respective rails 61 and 62 face the plasma generation region 25 (see FIG. 1). Further, a distance between the first ends 61*a* and 62*a* may be less than a distance between second ends 61*b* and 62*b* of the respective rails 61 and 62.

The target transport mechanism 65 may include rollers 63 and 64 to be driven by a stepping motor, which will be described later. The target transport mechanism 65 may be configured to transport a target material by a predetermined amount toward the second ends 61*b* and 62*b* of the respective rails 61 and 62 so that the target material is held between the rails 61 and 62 and is in contact with the rails 61 and 62. The target material in this case may be in a solid state and may be a thin wire 67*b*.

The power supply 66 may have a first terminal and a second terminal, and the first and second terminals may be connected to the second ends 61*b* and 62*b*, respectively. The power supply 66 may supply a current to the wire 67*b* through the rails 61 and 62 that are in contact with the wire 67*b*. The current may be a DC current. The power supply 66 may be a constant-current power supply or capable of having its current controlled. Further, the power supply 66 may be capable of measuring a voltage between the rails 61 and 62.

3.2 Operation

Figure 3A:
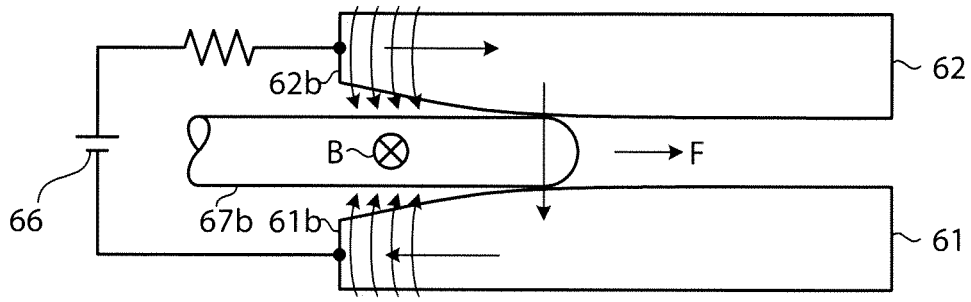
FIG. 3A is a plan view for discussing how a target supply device of the first example operates.
Figure 3B:
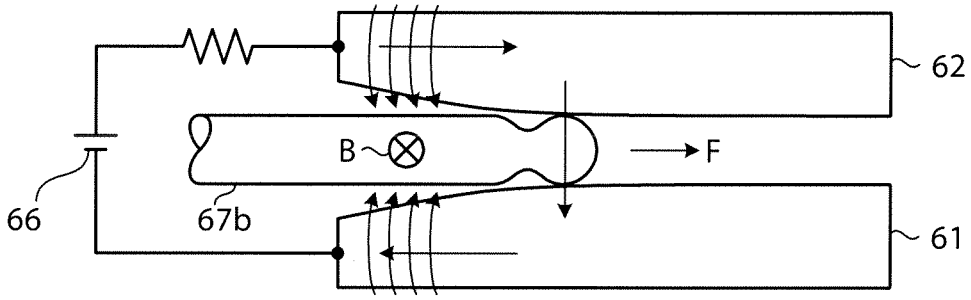
FIG. 3B is another plan view for discussing how a target supply device of the first example operates.
Figure 3C:
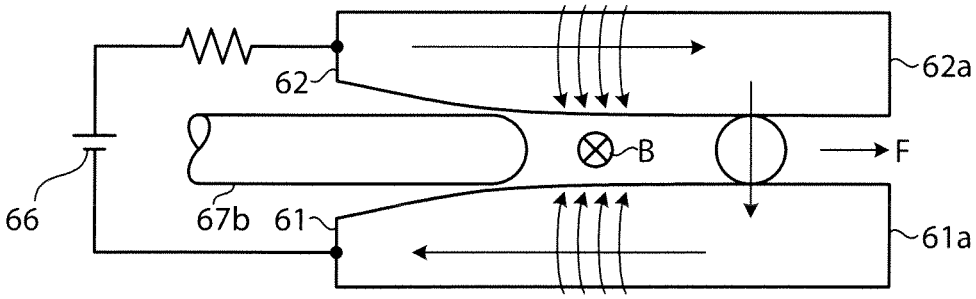
FIG. 3C is yet another plan view for discussing how a target supply device of the first example operates.

FIGS. 3A through 3C are plan views for discussing how a target supply device of the first example operates. As shown in FIG. 3A, the wire 67*b* may be transported to be held between the respective rails 61 and 62. When the leading end of the wire 67*b* comes into contact with the rails 61 and 62, a current path may be formed with the power supply 66, the rails 61 and 62, and the aforementioned leading end of the wire 67*b*. The power supply 66 may then pass a current to this current path.

When a current flows in the current path, a magnetic field may be generated around the current path as per Ampere's law, as shown in FIG. 3A. This magnetic field may appear as a strong magnetic field B particularly between the rails 61 and 62. Further, when a current flows in the stated current path, Joule heat may occur in the current path. Joule heat that occurs at various parts of the current path may be proportionate to electrical resistance at the given part. When the wire 67*b* has higher electrical resistance than the rails 61 and 62, the temperature at the leading end of the wire 67*b* may rise locally, and thus the wire 67*b* may melt at the leading end thereof.

Further, the leading end of the wire 67*b* may be subjected to the Lorentz force in a direction shown by an arrow F due to the magnetic field B and the current flowing at the leading end of the wire 67*b* as per Fleming's left-hand rule. Through this Lorentz force, a molten portion at the leading end of the wire 67*b* may be pulled to be extended, as shown in FIG. 3B.

When the molten portion at the leading end of the wire 67*b* is pulled even further, at least a part of the molten portion at the leading end of the wire 67*b* may be separated from the rest of the wire 67*b* due to the surface tension, as shown in FIG. 3C. The separated part may be accelerated due to the Lorentz force in accordance with the magnitude of the current and the magnetic field. Then, the separated part may be discharged as a target through a space between the first ends 61*a* and 62*a* with its momentum being conserved.

4. DETAILS OF TARGET SUPPLY DEVICE

4.1 Configuration

Figure 4A:
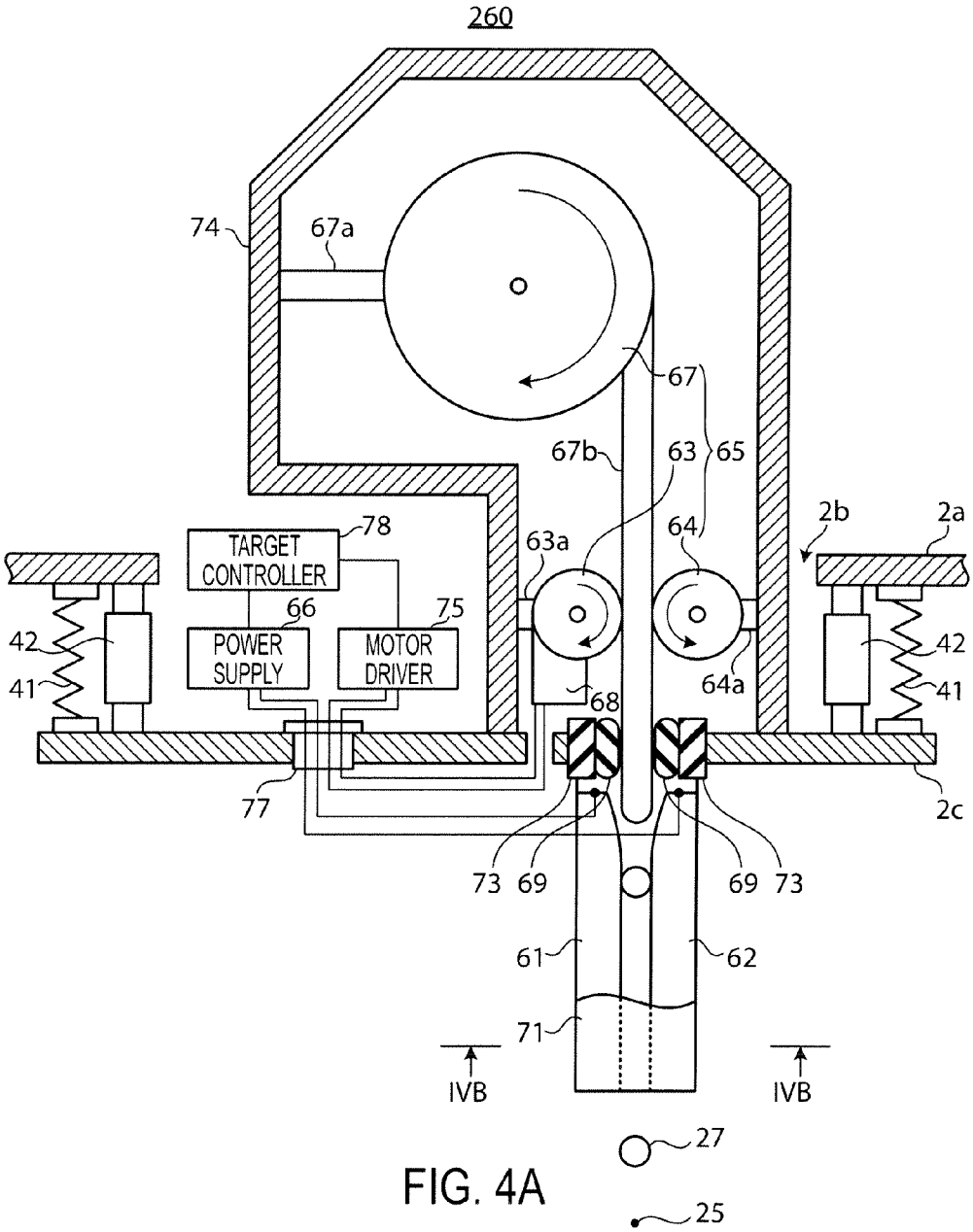
FIG. 4A is a partial sectional view illustrating details of a target supply device of the first example.
Figure 4B:
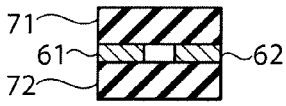
FIG. 4B is a sectional view of a pair of rails shown in FIG. 4A, taken along IVB-IVB plane.

FIG. 4A is a partial sectional view illustrating details of a target supply device of the first example. FIG. 4B is a sectional view of a pair of rails shown in FIG. 4A, taken along IVB-IVB plane. The target supply device 260 may be configured to supply targets into the chamber 2 through a through-hole 2*b* formed in a wall 2*a* of the chamber 2.

A flexible pipe 41 may be connected between the wall 2*a* of the chamber 2 and a support plate 2*c* inside the chamber 2 to airtightly seal the chamber 2. More specifically, a first end of the flexible pipe 41 may be fixed airtightly to the wall 2*a* around the through-hole 2*b*, and a second end of the flexible pipe 41 may be airtightly fixed to the support plate 2*c*. The flexible pipe 41 may be bellows that withstands stress which occurs due to a difference in pressure inside and outside the chamber 2.

A plurality of actuators 42 may be connected between the wall 2*a* and the support plate 2*c* inside the flexible pipe 41. Three actuators 42 may be provided. The rails 61 and 62 and the target transport mechanism 65 may be supported by the support plate 2*c*.

The rails 61 and 62 may be sandwiched by electrically insulating guides 71 and 72 (see FIG. 4B). The insulating guides 71 and 72 may be supported by an insulating holder 73, and thus the insulating guides 71 and 72 and the rails 61 and 62 may be supported by the support plate 2*c* inside the chamber 2. The insulating holder 73 may be fixed at the periphery of a through-hole formed in the support plate 2*c*. The insulating holder 73 may have both electrically and thermally non-conductive properties.

The target transport mechanism 65 may be housed in a housing case 74 fixed on an outer-side surface of the support plate 2*c*. The target transport mechanism 65 may include the rollers 63 and 64, a wire reel 67, and a stepping motor 68. The rollers 63 and 64 and the wire reel 67 may be rotatably supported by holders 63*a*, 64*a*, and 67*a* respectively inside the housing case 74. The holders 63*a*, 64*a*, and 67*a* may electrically insulate the rollers 63 and 64 and the wire reel 67 from the housing case 74. The wire reel 67 may be replaceable. The stepping motor 68 may be supported by the holder 63*a* to rotate the roller 63.

The wire 67*b* serving as a target material may be wound around the wire reel 67. The wire 67*b* may be taken out from the wire reel 67, may pass through a space between the rollers 63 and 64, and may pass through a space inside a wire guide 69 fixed on the insulating holder 73. The wire guide 69 may have electrically non-conductive properties. The wire guide 69 may hold side surfaces of the wire 67*b* so that the wire 67*b* is fed into a space between the rails 61 and 62.

The stepping motor 68 may be connected to a motor driver 75 through a wire. Each of the rails 61 and 62 may be connected to the power supply 66 through a wire. The wire connecting the stepping motor 68 to the motor driver 75 and the wires connecting the rails 61 and 62 to the power supply 66 may pass through a feedthrough 77 provided in the support plate 2*c*. The motor driver 75 and the power supply 66 may be connected to a target controller 78 through respective signal lines. The target controller 78 may be configured to send control signals to the motor driver 75 and the power supply 66. The motor driver 75 may be configured to drive the stepping motor 68. The power supply 66 may be configured to supply a constant current to the rails 61 and 62 when the rails 61 and 62 are in conduction with a predetermined resistance therebetween.

4.2 Operation

Each of the actuators 42 may extend or contract in accordance with a drive signal from an actuator driver, which will be described later, to adjust the position and the posture of the support plate 2*c* relative to the wall 2*a*.

The stepping motor 68 may rotate the roller 63 by a predetermined angle in accordance with a drive signal from the motor driver 75 to take out the wire 67*b* from the wire reel 67 and feed the wire 67*b* into a space between the rails 61 and 62.

The stepping motor 68 may stop the roller 63 when the leading end of the wire 67*b* comes into contact with the rails 61 and 62. More specifically, the power supply 66 may measure a voltage between the rails 61 and 62, and when the power supply 66 detects that the wire 67*b* has come into contact electrically with the rails 61 and 62, the power supply 66 may send a signal to the target controller 78. The target controller 78 may then send a signal to the motor driver 75 to cause the stepping motor 68 to stop the roller 63.

When the leading end of the wire 67*b* comes into contact with the rails 61 and 62, a current path may be formed with the power supply 66, the rails 61 and 62, and the leading end of the wire 67*b*. Then, as discussed with reference to FIGS. 3A through 3C, a target 27 may be outputted toward the plasma generation region 25 inside the chamber 2. The power supply 66 may control the current to flow in the rails 61 and 62 to control the speed of a target 27.

The power supply 66 may measure a voltage between the rails 61 and 62, and when the power supply 66 detects a target 27 being outputted, the power supply 66 may send a target output complete signal to the target controller 78. When a predetermined time elapses after a target output complete signal is received, the target controller 78 may send a wire supply signal to the motor driver 75. The aforementioned predetermined time may be determined based on a target repetition rate at which targets 27 are to be outputted.

According to the first example, the rails 61 and 62 and the insulating guides 71 and 72 may be formed of a material that withstands a temperature that is higher than the melting point of a target material. Since the target material may be molten only by an amount required to generate a single target 27, compared to a case where the entire target material is kept in a molten state during operation, less energy may be required to melt the target material.

5. SECOND EXAMPLE

Figure 5A:
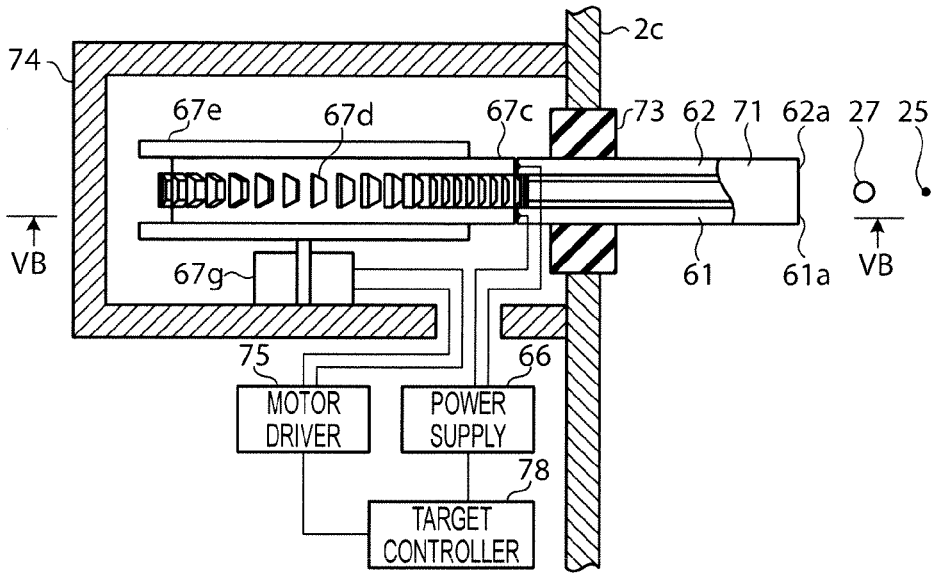
FIG. 5A is a partial sectional view schematically illustrating an exemplary configuration of a target supply device of a second example.
Figure 5B:
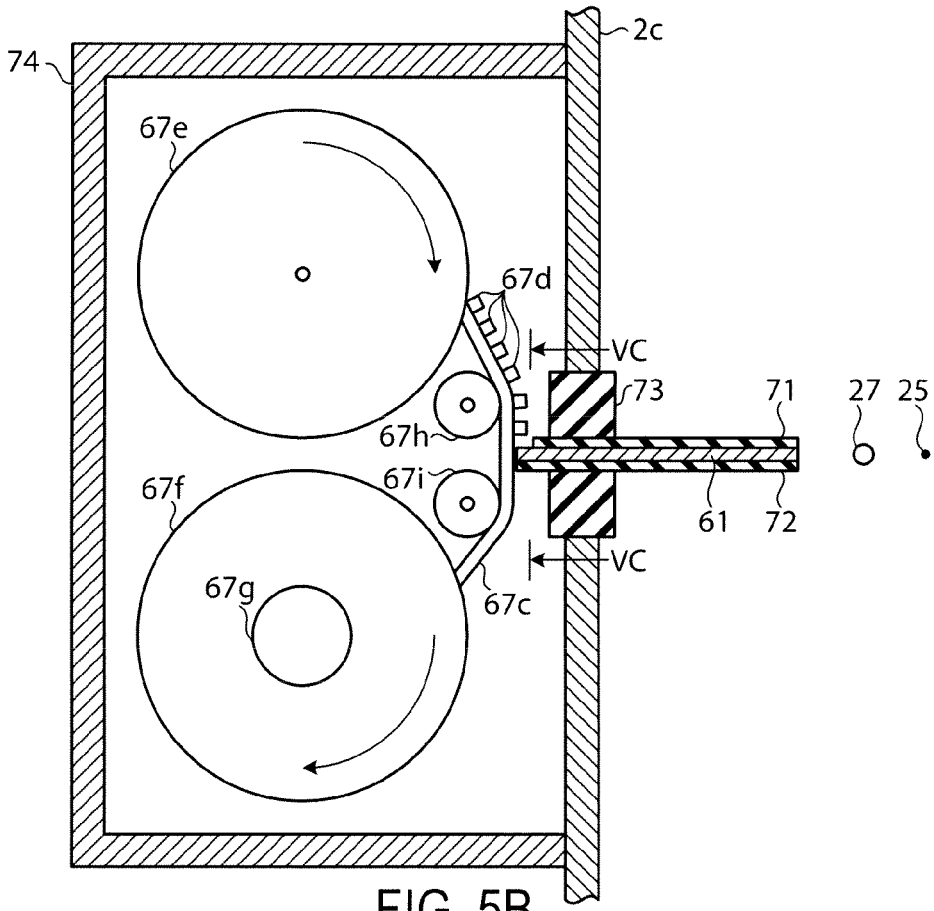
FIG. 5B is a sectional view of the target supply device shown in FIG. 5A, taken along VB-VB plane.
Figure 5C:
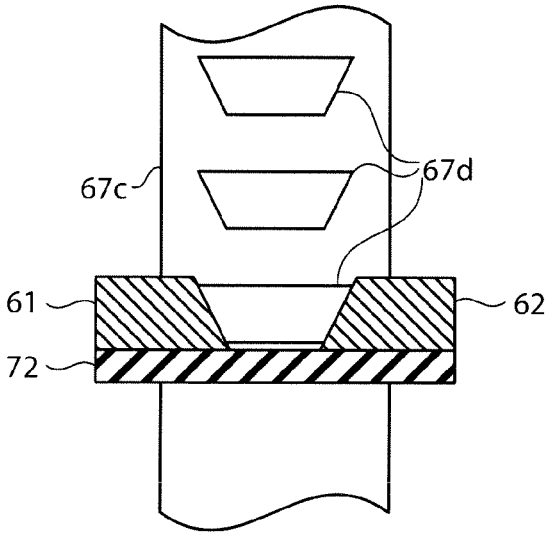
FIG. 5C is a sectional view of a pair of rails shown in FIG. 5B, taken along VC-VC plane.

FIG. 5A is a partial sectional view schematically illustrating an exemplary configuration of a target supply device of a second example. FIG. 5B is a sectional view of the target supply device shown in FIG. 5A, taken along VB-VB plane. FIG. 5C is a sectional view of a pair of rails shown in FIG. 5B, taken along VC-VC plane.

In the second example, a target material may be supplied into a space between the rails 61 and 62 in the form of target pieces 67*d* attached to a tape 67*c*. A plurality of target pieces 67*d* may be attached to the tape 67*c* to be spaced apart by a predetermined distance. The tape 67*c* on which the target pieces 67*d* are attached may be wound around a tape supply reel 67*e*.

When the tape 67*c* taken out from the tape supply reel 67*e* reaches a space between the rails 61 and 62, a target piece 67 shaped like a truncated quadrangular pyramid may be stuck between the rails 61 and 62, as shown in FIG. 5C, and a current path passing through the power supply 66 may be formed. The target piece 67*d* that has reached a space between the rails 61 and 62 may be molten through Joule heat, as in the first example. The molten target piece 67*d* may be accelerated along the rails 61 and 62 due to the Lorentz force and outputted through the space between the first ends 61*a* and 62*a* of the rails 61 and 62.

After a target piece 67*d* is outputted as a target 27, the tape 67*c* may be taken up by a tape take-up reel 67*f*. A stepping motor 67*g* may be attached to the tape take-up reel 67*f* to drive the tape take-up reel 67*f*. Guide rollers 67*h* and 67*i* may be provided between the tape supply reel 67*e* and the tape take-up reel 67*f* to regulate the path of the tape 67*c*. Each of the tape supply reel 67*d* and the tape take-up reel 67*f* may be replaceable.

According to the second example, the volume of an outputted target may be retained constant in accordance with an amount of a target piece 67*d*. Thus, stability in output intervals and output speed of the target may be improved.

6. THIRD EXAMPLE

Figure 6A:
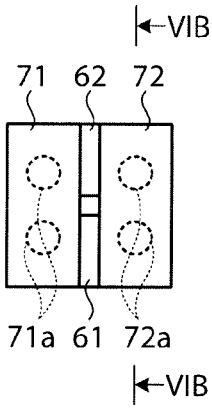
FIG. 6A schematically illustrates a pair of rails in a target supply device of a third example, as viewed from a side at which a target is outputted.
Figure 6B:
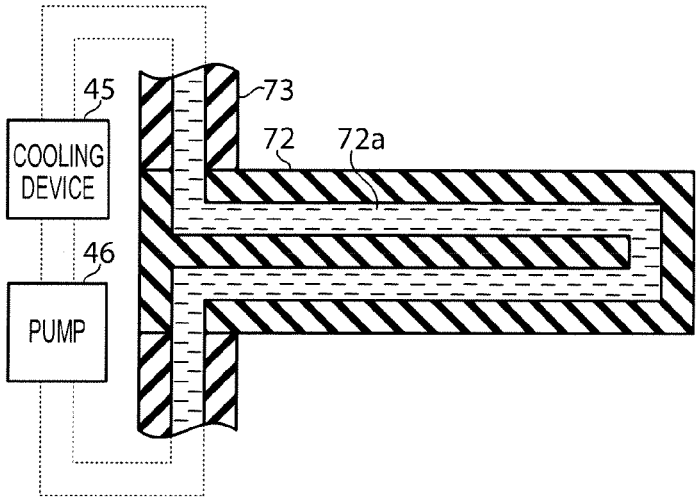
FIG. 6B is a sectional view of the pair of rails shown in FIG. 6A, taken along VIB-VIB plane.

FIG. 6A schematically illustrates a pair of rails in a target supply device of a third example, as viewed from a side at which a target is outputted. FIG. 6B is a sectional view of the pair of rails shown in FIG. 6A, taken along VIB-VIB plane.

In the third example, cooling medium flow channels 71*a* and 72*a* may be formed in the insulating guides 71 and 72, respectively. A cooling device 45 and a pump 46 may be connected to the cooling medium flow channels 71*a* and 72*a*. A cooling medium such as water for which the temperature has been adjusted by the cooling device 45 may be circulated through the cooling medium flow channels 71*a* and 72*a* by the pump 46. Thus, the rails 61 and 62 may be cooled and prevented from being overheated and eroded.

7. FOURTH EXAMPLE

Figure 7A:
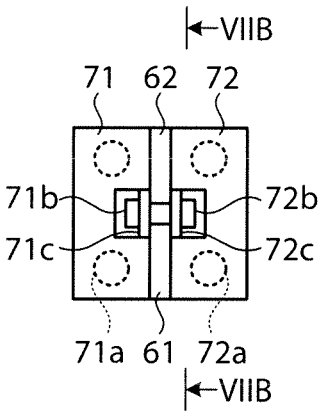
FIG. 7A schematically illustrates a pair of rails in a target supply device of a fourth example, as viewed from a side at which a target is outputted.
Figure 7B:
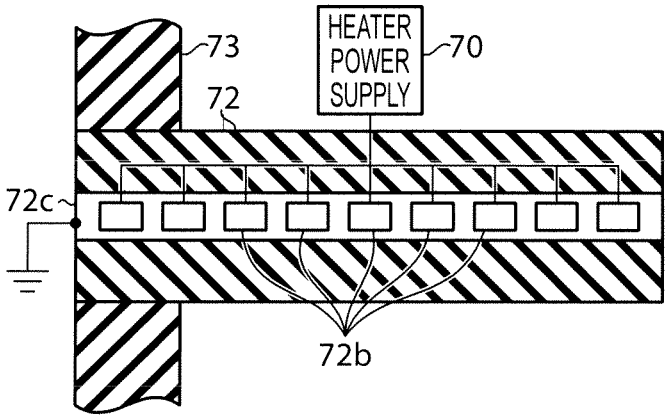
FIG. 7B is a sectional view of the pair of rails shown in FIG. 7A, taken along VIIB-VIIB plane.

FIG. 7A schematically illustrates a pair of rails in a target supply device of a fourth example, as viewed from a side at which a target is outputted. FIG. 7B is a sectional view of the pair of rails shown in FIG. 7A, taken along VIIB-VIIB plane.

In the fourth example, a plurality of space heaters 71*b* and a plurality of space heaters 72*b* may be provided on the insulating guides 71 and 72, respectively. A heat exchanger plate 71*c* may be provided between the plurality of space heaters 71*b* and the pair of rails 61 and 62, and a heat exchanger plate 72*c* may be provided between the plurality of space heaters 72*b* and the pair of rails 61 and 62.

A power may be supplied to the plurality of space heaters 71*b* and the plurality of space heaters 72*b* from a heater power supply 70 to heat the rails 61 and 62 through the heat exchanger plates 71*c* and 72*c*. Thus, when a target material comes into contact with the rails 61 and 62, the target material may melt.

8. FIFTH EXAMPLE

Figure 8A:
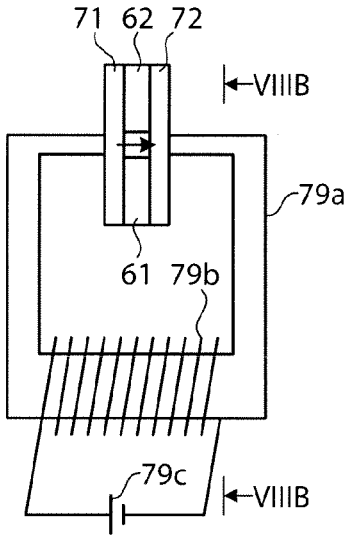
FIG. 8A schematically illustrates a pair of rails in a target supply device of a fifth example, as viewed from a side at which a target is outputted.
Figure 8B:
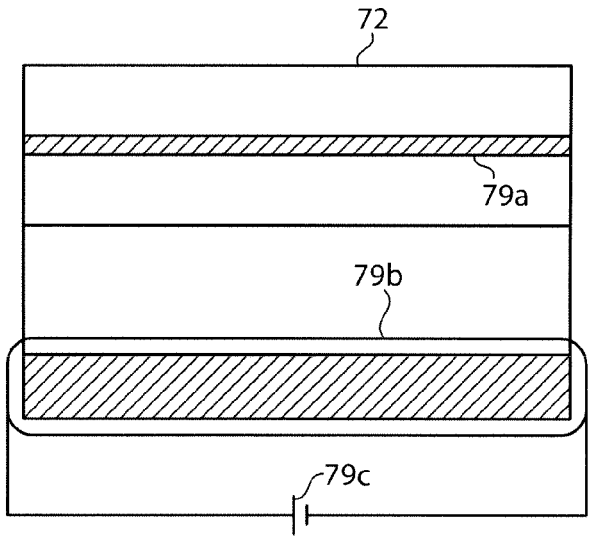
FIG. 8B is a sectional view of the pair of rails shown in FIG. 8A, taken along VIIIB-VIIIB plane.

FIG. 8A schematically illustrates a pair of rails in a target supply device of a fifth example, as viewed from a side at which a target is outputted. FIG. 8B is a sectional view of the pair of rails shown in FIG. 8A, taken along VIIIB-VIIIB plane.

In the fifth example, an electromagnet may be provided to hold the insulating guides 71 and 72 to generate a magnetic field in a space between the rails 61 and 62. The electromagnet may include a yoke 79*a*, a winding 79*b*, and a magnetic field generation power supply 79*c*. The winding 79*b* may be wound around the yoke 79*a*. The magnetic field generation power supply 79*c* may supply a DC current to the winding 79*b* to thereby generate a magnetic field inside the yoke 79*a*. The magnetic field generation power supply 79*c* may be capable of adjusting a current to supply to the winding 79*b*. The yoke 79*a* may extend in a longitudinal direction of the rails 61 and 62 to introduce the magnetic field into a target path between the rails 61 and 62. Each of the rails 61 and 62 may be formed of a paramagnetic material.

According to the fifth example, in addition to the magnetic field generated with a current passed through the rails 61 and 62 by the power supply 66 (see FIG. 2), a magnetic field generated by the electromagnet may act on the target material. Accordingly, independently from a current flowing in the rails 61 and 62, by adjusting a current supplied to the winding 79*b*, the Lorentz force to act on the target material may be adjusted.

9. SIXTH EXAMPLE

Figure 9A:
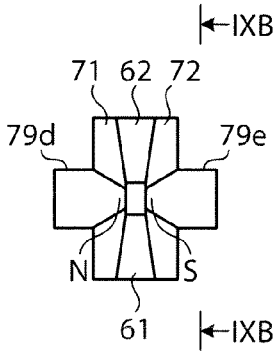
FIG. 9A schematically illustrates a pair of rails in a target supply device of a sixth example, as viewed from a side at which a target is outputted.
Figure 9B:
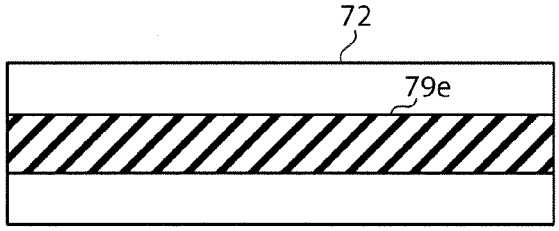
FIG. 9B is a sectional view of the pair of rails shown in FIG. 9A, taken along IXB-IXB plane.

FIG. 9A schematically illustrates a pair of rails in a target supply device of a sixth example, as viewed from a side at which a target is outputted. FIG. 9B is a sectional view of the pair of rails shown in FIG. 9A, taken along IXB-IXB plane.

In the sixth example, a part of each of the insulating guides 71 and 72 may be cut out to form a recess, and magnets 79*d* and 79*e* may be provided in the respective recesses. Each of the magnets 79*d* and 79*e* may be a permanent magnet. The magnets 79*d* and 79*e* may be arranged so that the tapered north pole N of the magnet 79*d* and the tapered south pole S of the magnet 79*e* face each other. Arranging the tapered magnetic poles to face each other in this way may allow the magnetic field to be enhanced in the target path between the rails 61 and 62.

10. SEVENTH EXAMPLE

10.1 Configuration

Figure 10:
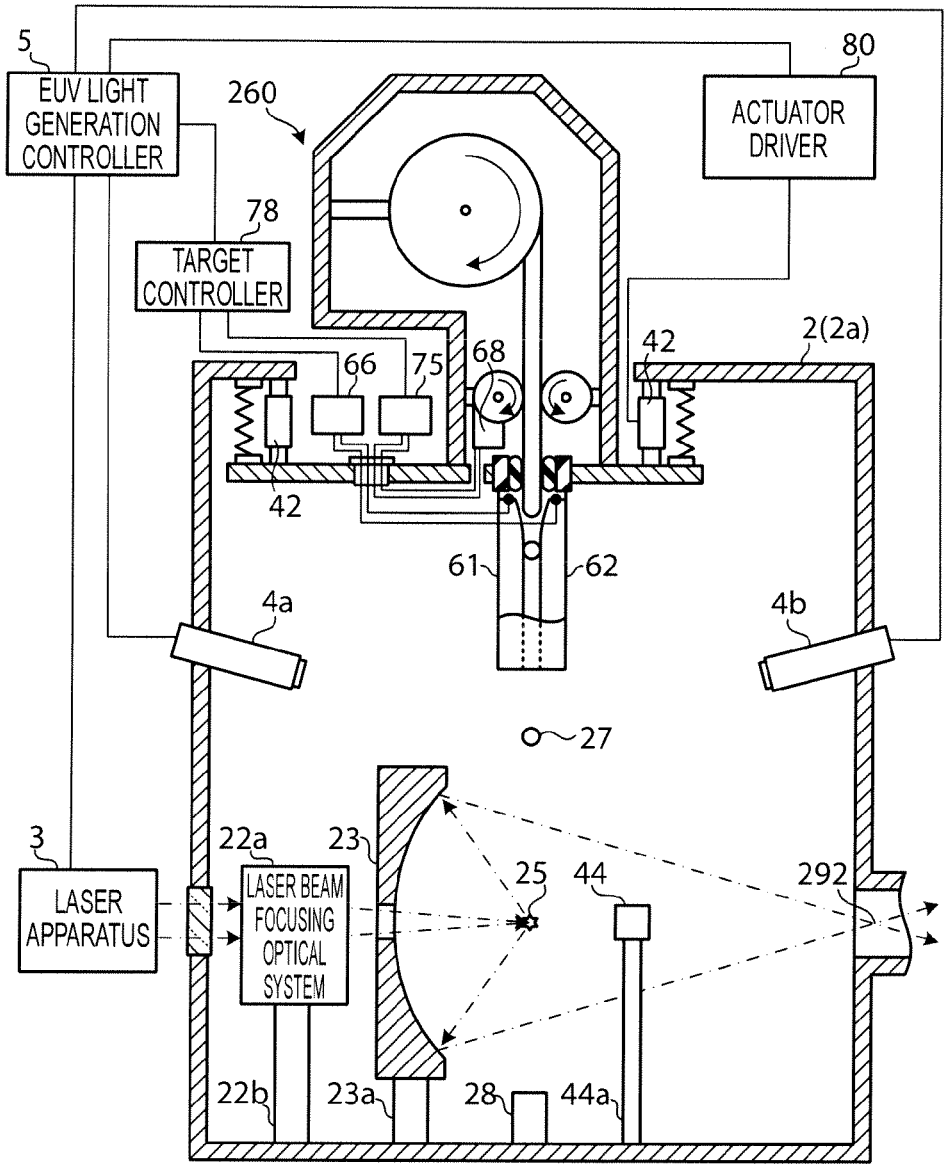
FIG. 10 is a partial sectional view schematically illustrating an exemplary configuration of an EUV light generation apparatus including a target supply device of a seventh example.

FIG. 10 is a partial sectional view schematically illustrating an exemplary configuration of an EUV light generation apparatus including a target supply device of a seventh example. The EUV light generation apparatus may include the chamber 2, the laser beam focusing optical system 22*a*, the EUV collector mirror 23, the target collector 28, and a beam dump 44.

The laser beam focusing optical system 22*a* may include at least one mirror and/or at least one lens (not shown). The laser beam focusing optical system 22*a* may be held by a holder 22*b* such that a pulse laser beam entering the laser beam focusing optical system 22*a* is focused in the plasma generation region 25.

The beam dump 44 may be fixed to the chamber 2 through a holder 44*a* to be positioned in an extension of a beam path of a pulse laser beam focused by the laser beam focusing optical system 22*a*. The target collector 28 may be provided in an extension of a designed trajectory of a target 27. The EUV collector mirror 23 may be held by an EUV collector mirror holder 23*a* such that EUV light emitted in the plasma generation region 25 is reflected thereby to be focused in the intermediate focus region 292.

Target sensors 4*a* and 4*b* may be provided on the wall 2*a* of the chamber 2. The target sensors 4*a* and 4*b* may detect a position and a timing at which a target passes through a predetermined plane perpendicular to a designed trajectory of a target.

The EUV light generation controller 5 may be connected to the target controller 78 through a signal line. The EUV light generation controller 5 may also be connected to an actuator driver 80 through a signal line. The actuator driver 80 may be connected to the actuators 42 through signal lines.

10.2 Operation

The EUV light generation controller 5 may receive an EUV light output signal from an external apparatus such as the exposure apparatus 6 (see FIG. 1). An EUV light output signal may include information on a repetition rate of an EUV light output. The EUV light generation controller 5 may send a target output signal to the target controller 78 based on a received EUV light output signal. The target controller 78 may control the target supply device 260 to output targets 27 based on a received target output signal.

The target sensors 4*a* and 4*b* may detect a timing at which a target 27 passes through a predetermined position. The target sensors 4*a* and 4*b* may send a detection result to the EUV light generation controller 5. The EUV light generation controller 5 may calculate an output repetition rate of targets 27 from detection results of multiple targets 27. If a difference between the calculated repetition rate and the output repetition rate of the EUV light is equal to or greater than a predetermined threshold, the EUV light generation controller 5 may adjust a timing for sending a target output signal.

The EUV light generation controller 5 may calculate a timing at which a target 27 reaches the plasma generation region 25 from a detection result of the target sensors 4*a* and 4*b*, and send a laser beam output signal to the laser apparatus 3 so that the laser beam is focused in the plasma generation region 25 at a timing at which the target 27 reaches the plasma generation region 25.

Here, an EUV light output signal which the EUV light generation controller 5 receives may include a target output repetition rate of targets 27 in accordance with the output repetition rate of the EUV light. The EUV light generation controller 5 may adjust a timing for sending a target output signal using the information on the target output repetition rate of targets 27.

The power supply 66 may detect a voltage between the rails 61 and 62 and send a detection result to the target controller 78. The target controller 78 may calculate an output repetition rate of targets 27 from the received detection results. The target controller 78 may compare the calculated output repetition rate of the targets 27 with a target output signal, and adjust a timing for driving the stepping motor 68 based on a comparison result.

The target sensors 4*a* and 4*b* may send a signal pertaining to a position at which a target 27 passes through to the EUV light generation controller 5. The EUV light generation controller 5 may send a signal to the actuator driver 80 to correct an output position and an output angle of the target supply device 260 based on this signal so that the target 27 reaches the plasma generation region 25. The actuator driver 80 may drive the actuators 42 based on this signal.

The above-described configuration may allow a feedback control to be carried out on the output repetition rate of the targets 27 by the target supply device 260 and the output position and the output angle of the target. Thus, EUV light may be generated at a predetermined repetition rate in the plasma generation region 25.

The above-described examples and the modifications thereof are merely examples for implementing the present disclosure, and the present disclosure is not limited thereto. Making various modifications according to the specifications or the like is within the scope of the present disclosure, and other various examples are possible within the scope of the present disclosure. For example, the modifications illustrated for particular ones of the examples can be applied to other examples as well (including the other examples described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. An apparatus for generating extreme ultraviolet light, the apparatus comprising:

a target supply device including a pair of rails arranged to face each other, the rails having electrically conductive properties, a target transport mechanism configured to supply a target material into a space between the rails, the target material to be in contact with the rails, and a power supply connected to the rails and configured to supply a current to the target material through the rails;

a chamber provided with an inlet through which an externally supplied laser beam is introduced into the chamber;

a laser beam focusing optical system for focusing the externally supplied laser beam in the chamber;

a sensor for detecting a target outputted from the target supply device in the chamber; and a controller for controlling the target supply device based on a detection result of the sensor.

2. The apparatus according to claim 1, wherein the power supply supplies a DC current to the rails.

3. The apparatus according to claim 1, wherein:

the target material is supplied in a solid state, and the power supply supplies a DC current to the rails to melt the target material.

4. The apparatus according to claim 1, wherein:

the target material is supplied in a solid state, the power supply supplies the current to the target material to melt at least a part of the target material, and the target transport mechanism is configured so that the at least a part of the target material is separated from the target transport mechanism after being molten by the current.

5. The apparatus according to claim 1, wherein the target supply device further includes:

a support member configured to support the rails and the target transport mechanism; and a plurality of actuators configured to adjust a position and a posture of the support member.

6. The apparatus according to claim 1, wherein the target supply device further includes:

a first insulating member being in contact with first surfaces of the respective rails, the first surfaces being along with longitudinal directions of the respective rails; and a second insulating member being in contact with second surfaces of the respective rails, the second surfaces being opposite to the first surfaces of the respective rails.

7. The apparatus according to claim 6, wherein the target supply device further includes:

a first flow channel for a thermal medium, the first flow channel being arranged to the first insulating member; and a second flow channel for the thermal medium, the second flow channel being arranged to the second insulating member.

8. The apparatus according to claim 1, wherein the target supply device further includes a heater for heating the rails.

9. The apparatus according to claim 1, wherein the target supply device further includes a magnet configured to generate a magnetic field in a substantially same direction as a magnetic field generated between the rails by the current.

10. The apparatus according to claim 1, wherein:

the target transport mechanism is configured to support a first part of a solid target material and to supply a second part of the solid target material into a space between the rails, the second part to be in contact with the rails, and the power supply supplies the current to the second part to melt the second part so that the second part is separated from the first part.

11. The apparatus according to claim 1, wherein:

the target transport mechanism is configured to support a tape to which a plurality of solid target pieces is attached and to supply one target piece of the plurality of solid target pieces into a space between the rails by moving the tape along with a predetermined path, the one target piece to be in contact with the rails, and the power supply supplies the current to the one target piece.

12. A method for generating extreme ultraviolet light, comprising:

transporting a target material by a target transport mechanism into a space between a pair of rails, the target material to be in contact with the rails, the rails being arranged to face each other and the rails having electrically conductive properties;

supplying a current to the target material through the rails to melt the target material and to output a target from the space between the rails; and irradiating the target with a laser beam to generate plasma.

* * * * *